United States Patent [19]

Leopold et al.

[11] Patent Number: 4,546,723

[45] Date of Patent: Oct. 15, 1985

[54] METHOD AND APPARATUS FOR APPLYING SEALANT TO INSULATING GLASS PANEL SPACER FRAMES

[75] Inventors: Edmund A. Leopold, Hudson; Glen D. McKeown, Rootstown, both of Ohio

[73] Assignee: Glass Equipment Development, Inc., Twinsburg, Ohio

[21] Appl. No.: 602,195

[22] Filed: Apr. 19, 1984

[51] Int. Cl.[4] ..... B05C 5/02; B05D 5/10

[52] U.S. Cl. ..... 118/669; 156/109; 427/8; 428/34

[58] Field of Search ..... 118/669; 427/8; 156/109; 428/34

[56] References Cited

U.S. PATENT DOCUMENTS 4,268,553 5/1981 Marzouki et al. ..... 156/109 X

*Primary Examiner*—James R. Hoffman

*Attorney, Agent, or Firm*—Watts, Hoffmann, Fisher & Heinke

[57] ABSTRACT

Partially assembled spacer frames formed by a plurality of joined spacer frame segments are advanced past a sealant applying station defined by first and second sealant extrusion nozzles positioned for applying sealant to opposite spacer frame segment sides and a third sealant extrusion nozzle positioned for applying sealant to the exterior spacer frame side. Extrusion nozzle controllers render the nozzles operative to apply sealant to the spacer frame segments in response to control signals. A spacer frame detection system produces signals indicating the presence of the spacer frame at the sealant application station. A signal processor coupled to the detection system and to the nozzle controller produces control signals for intermittently operating the third extrusion nozzle in response to the presence of the leading end of the spacer frame segments at said station, and the approach of the junctures of subsequent spacer frame segment ends and the trailing frame end. The signal processor also provides signals for operating the first and second nozzles continuously while the spacer frame is at the station.

22 Claims, 14 Drawing Figures

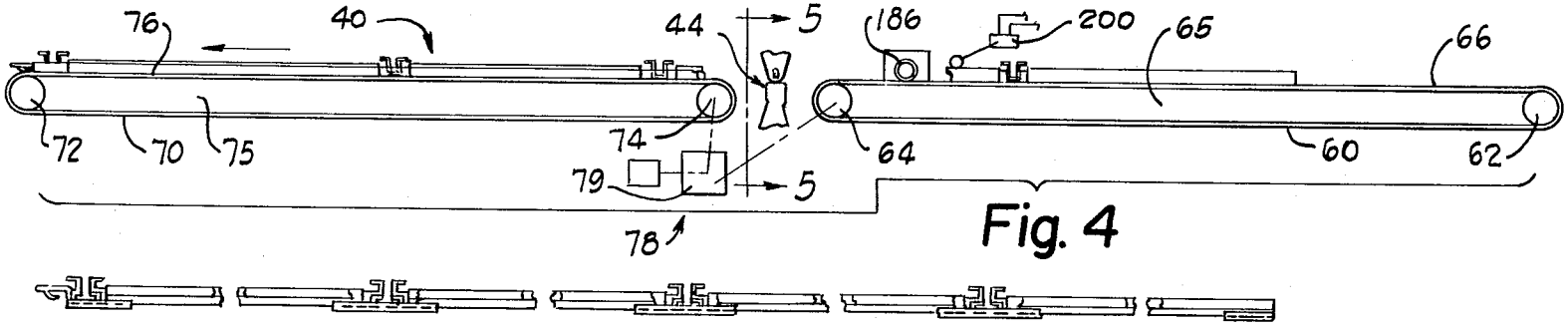
Fig. 4
Fig. 8
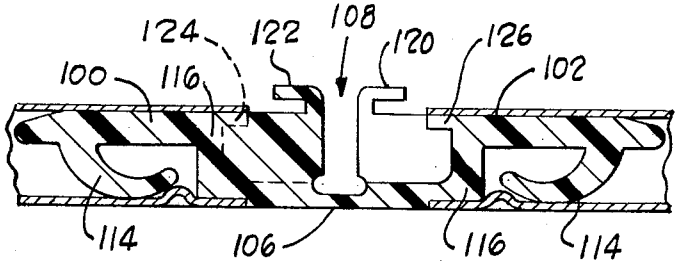
Fig. 6
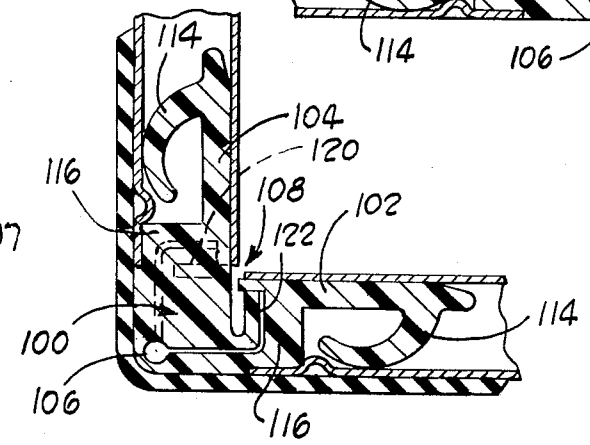
Fig. 7
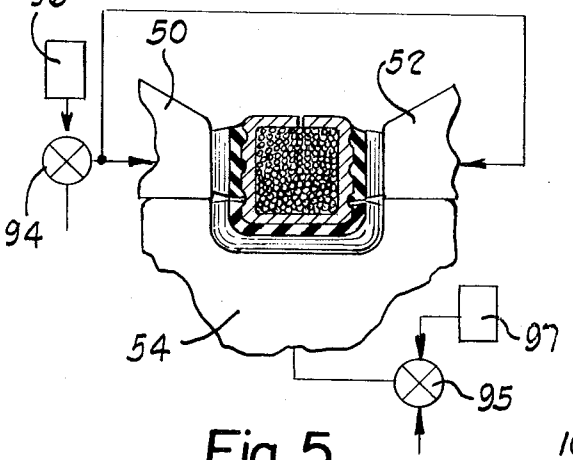
Fig. 5

METHOD AND APPARATUS FOR APPLYING SEALANT TO INSULATING GLASS PANEL SPACER FRAMES

TECHNICAL FIELD

The present invention relates to insulating glass panels or the like and more particularly to an improved method of panel fabrication.

Insulating glass panels of the sort commonly used as glazing in windows and doors are normally constructed by sandwiching a spacer frame assembly between sheets of glass, or equivalent material, and hermetically bonding the sheets to the spacer frame assembly. A finished panel is typically square or rectangular with the spacer frame assembly extending completely about and immediately adjacent the outer periphery. The panel can then be installed in a suitable supporting structure (such as a window frame) which masks the spacer frame assembly from view and enables the panel to be installed in a larger structure, such as an exterior building wall.

As its name implies the spacer frame assembly functions to space the glass sheets apart and thus provide an insulative "dead air" space between them. It is essential in such panels that the spacer frame assembly be and remain hermetically attached to the glass sheets throughout the expected life of the panel. If the air space between the glass sheets is not hermetic, atmospheric water vapor will eventually infiltrate the dead air space and inevitably, under appropriate atmospheric conditions, condense on the glass surfaces bounding the dead air space. While the presence of water vapor in the dead air space does not materially reduce the insulative effectiveness of the panel, condensation on the glass in the space "fogs" the glass, cannot be removed and the utility of the panel as a window is adversely affected. Moreover, repeated condensation and evaporation of such moisture within the panels results in the windows becoming permanently stained and unsightly even when there is no condensation in the panel.

BACKGROUND ART

In order to assure a hermetic bond between the spacer frame and the glass sheets a mastic-like sealant material has been applied to opposite sides of the spacer frame continuously about the panel. A typical sealant material, such as polyisobutylene or a Butyl "hot melt" adhesive, is applied to the spacer frame, the spacer frame assembly is sandwiched between the glass sheets, and the panel is subjected to high energy radiant heating while the glass sheets are pressed against the spacer frame assembly. The sealant is heated sufficiently to "melt" and flow into sealing and bonding contact between the glass and the spacer frame. Upon cooling, and in use, the sealant material is relatively rigid although it does tend to exhibit plastic flow characteristics under stress.

In use the insulating glass panels are subjected to appreciable temperature differentials and to frequent temperature "cycling." The spacer frames therefore have been subjected to stresses and strain resulting from temperature induced differential expansion and contraction. In panels where the spacer frame segments were not firmly secured together, the applied stresses sometimes resulted in the frame segments shifting apart and causing the sealant material to deform sufficiently to break the seal between the frame and the glass. While the structural integrity of the panels was not usually adversely affected, the broken seals permitted a migration of atmospheric moisture into the dead air space.

Accordingly the use of corner connectors between spacer frame segments for securing the segments together and rigidifying the corners was proposed. The corner connectors were usually formed of relatively rigid plastic or zinc alloy materials and when attached to the frame segments provided sufficient strength to maintain the integrity of the spacer frame assembly.

Even though insulating glass panel components were hermetically bonded together and the seal remained intact, atmospheric moisture was trapped in the air space when the panels were being assembled. The trapped airborne moisture often condensed within the panels. In order to avoid this problem the prior art proposed the use of tubular spacer frame segments containing particulate desiccant material. The spacer frame segments were constructed from aluminum or galvanized sheet steel and formed with slightly open interiorly facing seams which permitted the segments to "breathe," i.e., the seams enabled communication between the desiccant material and the panel air space while preventing loss of desiccant into the air space. The desiccant material was effective to dehumidify the air trapped in the panel air space.

The construction of the spacer frames and panels was complicated by the use of desiccant materials in the frame segments. In order to prevent dumping the desiccant material out of the frame segments the frame segments were filled with desiccant material and assembled together using corner connectors which both plugged the ends of the frame segments and formed the spacer frame corners. The plugging action of the corner connectors in the frame segment ends did not produce a gas tight seal at the ends of the frame segments, but was effective to prevent loss of the desiccant while handling during manufacture of the panels.

Applying the sealant material to the spacer frame was accomplished by moving one side of the spacer frame past two or more sealant extrusion nozzles at a controlled rate of travel and repeating the process for each side of the polygonal spacer frame.

The spacer frame assembly thus formed had a doubled layer of the sealant at each corner of the frame. These layers had to be manually smoothed out and feathered into the single sealant layers adjacent the frame corners to assure that an effective seal could be provided with the glass sheets.

This assembly process was most effectively performed by using two sealant extrusion machines with an operator for each machine being responsible for applying the sealant to the frames. The frame assemblies from each extrusion machine were then placed on a respective table where a finishing operator smoothed the sealant at the corners. An inspector was usually present to inspect the frame assemblies after the finishing operators had completed their ministrations.

Even though excess sealant was present at the frame corners there was not usually enough sealant to permit complete encapsulation of the exterior of the corner connector by sealant material. In fact, complete encapsulation of the corner connector was necessary to prevent leakage into or from the panels along paths extending between the corner connector and the spacer frame segment ends, to the spacer frame and then to the space between the glass panels in the internal openings in the spacer frame segments.

Accordingly a layer of sealant was sometimes applied around the external corners of the spacer frames during the frame finishing operation. This required use of a separate specialized sealant extrusion nozzle and supply arrangement and materially slowed the finishing operation.

Assembly of the panels was then completed in the manner described previously. In some manufacturing operations, the panels were constructed without first applying sealant to the external corners, but after the panel was constructed the entire external periphery of the assembly was coated with sealant. This step required an operator, frame handling equipment, and a specialized sealant applying apparatus.

The spacer frame assembly process was relatively slow because of the multiple step sealant applying procedure. The extrusion machine had to be started and stopped repeatedly during the application of sealant to a single spacer frame and the sealant was usually applied at a relatively low application rate. Furthermore, application of the coatings was often difficult and cumbersome for the extrusion machine operator, particularly when large size frames had to be coated. For example, when spacer frames for sliding glass door panels were coated, the frames themselves were sometimes six feet long, or longer, per side and although the frame segments were securely connected together, the frames were still quite flexible and thus extremely difficult for the operator to manipulate. Application of the frame corner sealant materials, as noted, was inconvenient and required specialized equipment.

The assembly process was labor intensive and therefore costly since as many as five persons were required to produce spacer frame assemblies preparatory to forwarding them to the insulating glass panel production equipment. It should be noted that spacer frames cannot effectively be produced and stockpiled for eventual use without risking loss of effectiveness of the desiccant material in the frame segments before final assembly of the panels.

DISCLOSURE OF THE INVENTION

The present invention provides a new and improved method and apparatus for constructing spacer frames for insulating glass panels or the like wherein frame segments are arranged with adjacent ends connected together at the eventual corner locations but with the ends of the end-most segments free. The frame segments are fed seriatim longitudinally past a sealant applying station and sealant is applied locally to bridge the frame segment junctures in response to signals indicating the presence of frame segment junctures at the sealant applying station. Adjacent frame segments are then pivoted relative to each other to form the spacer frame configuration, and the free ends of the endmost segments are attached together to complete the assembly.

In a preferred embodiment of the invention the leading and trailing ends of the frame segment assembly have sealant applied to their exterior sides so that when the segments are moved to their final configuration the exterior corners are sealed.

The preferred embodiment of the invention also provides for applying sealant continuously along the lateral sides of the frame segments from one end of the frame segment assembly to the other as the segments pass the sealant applying station.

Other features and advantages of the invention will become apparent from the following detailed description of a preferred embodiment made with reference to the accompanying drawings which form part of the specification.

BRIEF DESCRIPTION OF DRAWINGS

FIG. 4 is a schematic elevational view of part of the apparatus of FIG. 3;

FIG. 5 is a cross sectional view seen approximately from the plane indicated by the line 5—5 of FIG. 4;

FIG. 6 is a fragmentary cross sectional view of a corner key connector for a panel spacer frame constructed according to the invention;

FIG. 7 is a view similar to FIG. 6 but with parts in different relative positions;

FIG. 8 is an elevational view of a panel spacer frame bearing sealant applied according to the invention wherein portions of the spacer frame and sealant are broken away;

BRIEF MODE FOR CARRYING OUT THE INVENTION

Figure 1:
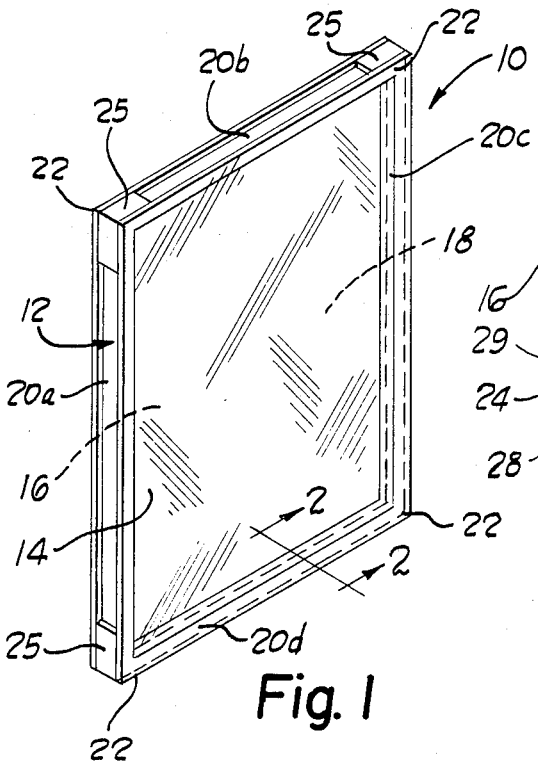
FIG. 1 is a perspective view of an insulating glass panel constructed according to the invention.
Figure 2:
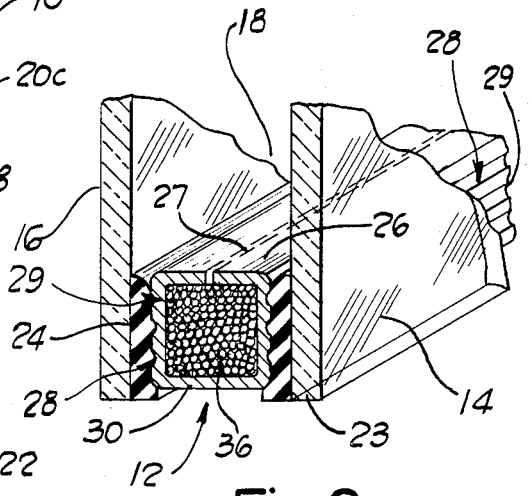
FIG. 2 is a fragmentary cross sectional view of part of the panel seen approximately from the plane indicated by the line 2—2 of FIG. 1.

An insulating glass panel 10 constructed in accordance with the present invention is illustraded by FIGS. 1 and 2 of the drawing. The insulating glass panel 10 includes a spacer frame assembly 12 sandwiched between sheets of glass 14, 16, or equivalent material, and bonded in place to the glass sheets 14, 16 to provide a hermetic air space 18 bounded by the sheets and the spacer frame assembly.

The spacer frame assembly 12 extends completely about the periphery of the panel 10 adjacent the peripheral edges of the sheets 14, 16 and is formed by frame segments **20*a*, 20*b*, 20*c*, 20*d* each forming one side of a rectangular generally planar spacer frame. The frame segments are joined at their ends to define frame corners 22. Opposite lateral sides of the frame are bonded to the glass sheets by respective bands of sealant material 23, 24 extending continuously about the frame periphery (see FIG. 2). The illustrated frame assembly 12 also includes sealant bodies 25 each extending about a respective corner on the outer periphery of the panel 10. The sealant bodies 23–25** assure that the sheets are hermetically bonded to the spacer frame assembly.

In the illustrated embodiment of the invention each frame segment is formed by a thin walled open ended tube. As is best illustrated by FIG. 2 each frame segment has a generally square or rectangular cross sectional shape having a side wall 26 extending along one side of the air space 18. The side wall 26 defines a perforate longitudinally extending seam 27. Opposite lateral side walls 28, formed with longitudinally extending ribs, or ridges, 29, face the sheets 14, 16, respectively. An exteriorly facing tube wall 30 extends along the outer periphery of the panel 10. The frame segments are preferably formed from aluminum or light gauge galvanized sheet steel since these materials are sufficiently strong and rigid to function as frame segments, exhibit good corrosion resistance and their structural integrity is not adversely affected by long term exposure to sunlight.

The sealant bodies 23–25 are preferably formed of material known in the industry as polyisobutylene. This material is relatively rigid at room and atmospheric temperatures but can flow under pressure when its temperature is elevated sufficiently above atmospheric temperature levels. The sealant bodies can be formed from other conventional or suitable materials, if desired.

As illustrated by FIG. 2, each spacer frame segment is filled with a particulate desiccant material 36 which is in communication with the air space 18 via the perforate seam 27 in the respective frame segment side wall 26. The desiccant material 36 dehumidifies air trapped in the space 18 during assembly of the panel 10 so that the possibility of condensation of moisture from the entrapped air is avoided. It should be appreciated that the perforate frame segment seam 27 is sufficiently narrow that the desiccant material 36 cannot pass through it.

In accordance with the present invention the spacer frame assembly 12 is constructed by arranging the frame segments 20*a–d* end to end, with adjacent ends of the spacer frame segments connected and applying the sealant bodies 23–25 to the aligned spacer frame segments in a single operational step from one free end to the other as the spacer frame segments are fed past a sealant application station. The frame segments are then pivoted with respect to each other about their adjacent ends and the free ends are connected to complete the spacer frame assembly.

The frame segments can be attached by any suitable connection scheme. The preferred connection arrangement employs a plastic member, called a corner key, which plugs the ends of the frame segments, hinges adjacent frame segment ends together, and permits the frame segments to be locked, or latched, in assembled position.

Figure 3:
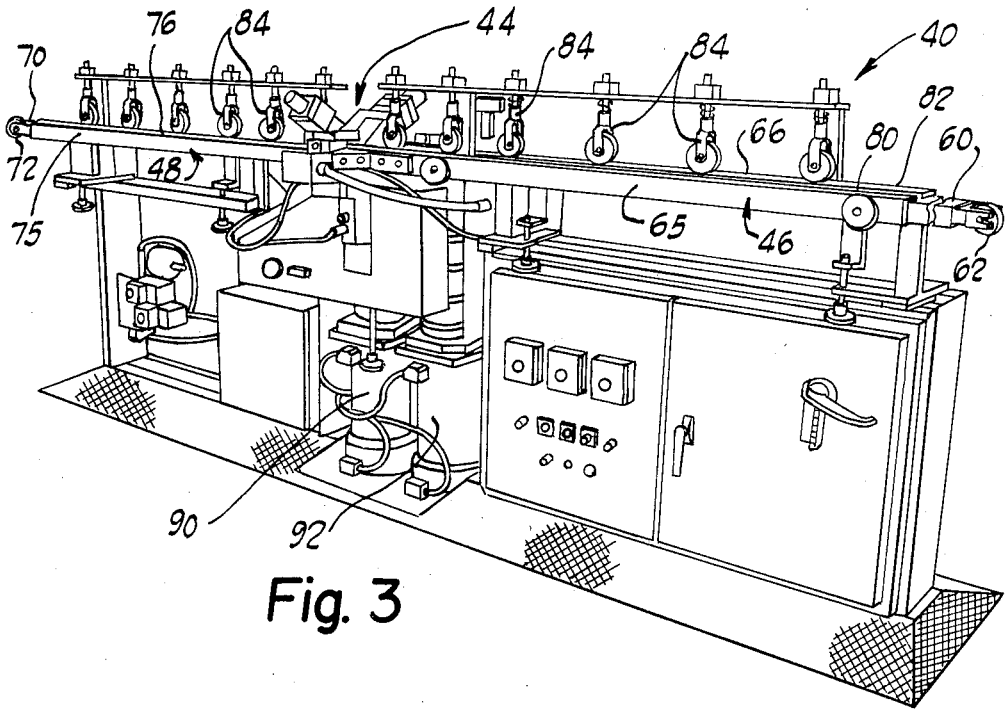
FIG. 3 is a perspective view of apparatus used in construction of part of the panel of FIG. 1.

FIGS. 3 and 4 illustrate a sealant applying machine 40 and frame assembly table (not illustrated). The machine 40 defines a sealant applying station 44 with frame segment conveyors 46, 48 for respectively feeding connected, aligned frame segments to and delivering them from the sealant applying station 44. The machine 40 includes three sealant extrusion nozzles 50, 52, 54 (see FIG. 5) disposed at the station 44. Each nozzle is constructed and positioned to direct a ribbon-like strip of sealant onto frame segments passing through the station 44. The nozzles 50, 52 are located at the respective opposite sides of the station 44 for applying the sealant bodies 23, 24 while the nozzle 54 is located below the station 44 and applies the sealant bodies 25. The nozzle 54 is constructed with its extrusion slot extending along the frame outer walls 30 and partially along the opposite side walls 28 so that the sealant body 25 is "wrapped" around the frame member corners between the walls 28, 30 (see FIG. 5). The sealant bodies 23, 24, 25 thus abut along their adjacent edges.

The sealant material is heated and flows under pressure through the nozzles as an extremely viscous fluid. The material engages and adheres to the frame segments so that the frame segments delivered from the station 44 carry strips of the sealant material on their lateral side walls 28 and at spaced apart locations on their outer walls 30.

The conveyors 46, 48 operate to move the frame segments through the station 44 at a constant speed which is related to the rate of extrusion of sealant through the nozzles 50, 52, 54 so that uniformly thick layers of sealant are applied to the frame segments. The conveyor 46 is formed by an endless belt 60 trained around rollers 62, 64 supported at opposite ends of a supporting frame 65. The belt 60 defines an upper reach 66 for supporting the frame segments while they are fed to the station 44.

The conveyor 48 is formed by an endless belt 70 trained around rollers 72, 74 on opposite ends of a conveyor supporting frame 75. The belt 70 defines an upper reach 76 for supporting the spacer frame segments as they are delivered from the station 44.

The belts 60, 70 are driven at identical surface speeds by a common drive mechanism 78 (schematically illustrated in FIG. 4) connected to the rollers 64, 74 adjacent the station 44. The preferred conveyor drive mechanism includes an electric drive motor whose output shaft is connected to the rollers 64, 74 via drive chains and appropriate sprockets.

The aligned frame segments 20*a–*20*d* are moved along the conveyor belts 66, 76 between opposed pairs of guide plates 80, 82 fixed to the respective supporting frames 65. The quide plates are disposed immediately adjacent the lateral sides of the frame segments and thus accurately position the frame segments for movement through the station 44 at predetermined distances from the side nozzles 50, 52.

Hold down rollers 84, are disposed along the belts 60, 70 to maintain the frame segments in positive driving contact with the belts between the guide plates 80, 82 and to assure that the frame segments are properly positioned with respect to bottom extension nozzle 54 when they pass through the station 44.

Sealant material is supplied to the nozzles 50, 52, 54 from either of two sealant chambers 90, 92 each provided with a hydraulic piston for maintaining the sealant under pressure and expelling it to the nozzles. When sealant is being supplied to the nozzles from one chamber, the sealant supply in the other chamber is replenished.

The sealant flow from both side nozzles 50, 52 is controlled by a pneumatically actuated needle valve 94 while a pneumatically operated needle valve 95 governs flow from the bottom nozzle 54. The valves 94, 95 can be of any suitable or conventional construction and are schematically illustrated by FIG. 5. The side nozzle needle valve 94 is controlled by a pneumatic controller valve unit 96 including a side nozzle controller solenoid. The bottom nozzle needle valve 95 is controlled by a pneumatic controller valve unit 97 including a bottom nozzle controller solenoid. When the controller valve unit solenoid 96 is energized the associated side nozzle control valve 94 opens to enable sealant flow from the side nozzles. When the solenoid 96 is deenergized the sealant flow control valve closes. Energization and deenergization of the bottom nozzle control solenoid 97 opens and closes, respectively, the bottom nozzle valve 95.

The plastic corner key connector 100 is illustrated by FIGS. 6 and 7 as comprising body portions 102, 104 connected to adjacent ends of spacer frame segments 20*a*, 20*b*; a molded-in hinge 106 for facilitating formation of a frame corner; and, a connecting arrangement 108 for securing the body portions in place with respect to each other when the frame segments are in their desired assembled orientation (FIG. 7). In the illustrated embodiment the frame segments form a right angle corner; but other relative orientations of the frame segments are possible.

The corner key body portions 102, 104 each have a hook-like construction 114 locked into place in the frame segment end and a plugging section 116 for sealing the frame segment end against loss of desiccant material. The hook construction 114 is securely fixed in the frame segment end by crimping the frame segment material.

The hinge 106 enables pivoting the frame segments with respect to each other to form a frame corner, and is preferably a thin strip of the plastic material formed continuously with the respective body portions and extending between them throughout their lateral extents. The corner key 100 is preferably formed from a single piece of plastic material, such as nylon, polypropylene, or polyethylene, molded so that the hinge strip is continuous with the body portions.

When the corner key connector 100 is flexed to form the frame corner surfaces the body portions 102, 104 are moved into confronting relationship and serve to stiffen the frame corner by preventing excessive flexure the frame corner (i.e. preventing the illustrated frame corner from flexing to an acute angle materially less than 90°), and resisting skewing of the frame segments out of a common plane.

The body portion connecting arrangement 108 is constructed and arranged to firmly latch the body portions 102, 104 in position with respect to each other when the frame corner is formed. As illustrated by FIGS. 6 and 7, first and second latching projections 120, 122 are formed, respectively, on the first and second body portions 102, 104 and are laterally offset from each other so that they do not contact each other when the frame corner is formed. When the frame corner is formed, the projections are moved into latching relationship with first and second keepers 124, 126 formed, respectively, by projection receiving recesses in the second and first body portions 104, 102. The reciprocal latching engagement between the body portions provides an extremely strong locking relationship between the body portions so that "opening" of the frame corner is strongly resisted.

Other, differently constructed corner key connectors can be utilized in the production of spacer frames according to the invention.

The corner keys 100 are assembled to the frame segment ends and the partially assembled frame is fed through the sealant applying station 44 with one corner key in the leading end of the frame segments and with the trailing frame segment end remaining open.

When the spacer frame segments move through the sealant applying station the side extrusion nozzles 50, 52 direct sealant onto the spacer frame segment side walls 28 continuously from the leading frame segment end to the trailing frame segment end to form the sealant bodies 23, 24. The bottom extrusion nozzle 54 intermittently directs sealant onto the leading and trailing frame segment ends and onto areas bridging the frame segment junctures to form the sealant bodies 25. The bodies 25 thus are located only at the corners of the assembled spacer frame and function to assure sealing the panel corners without the necessity for applying sealant completely about the panel exterior.

Figure 9:
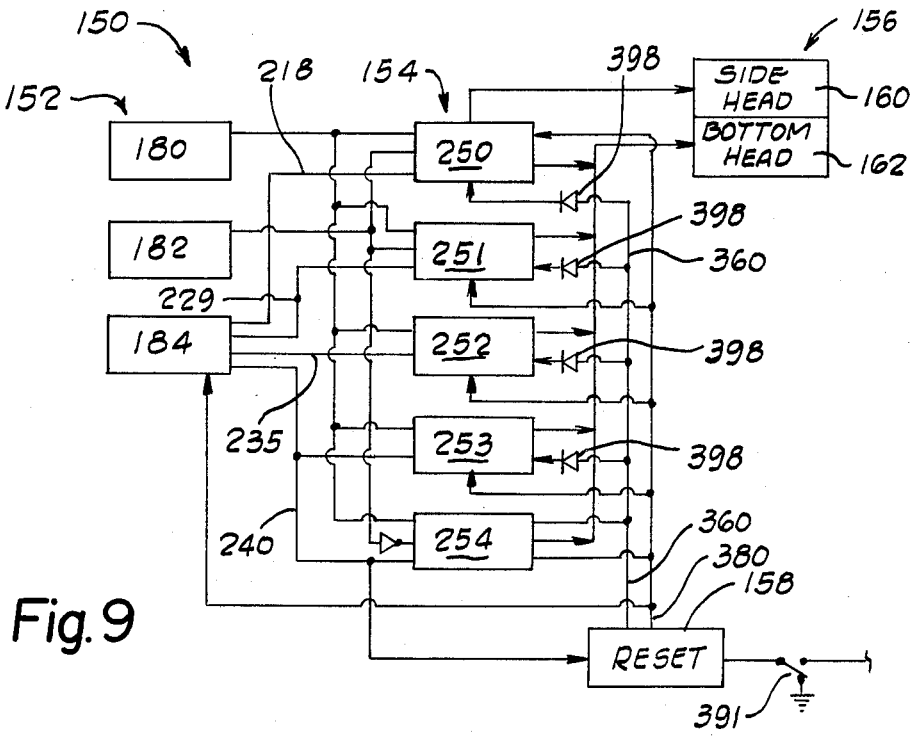
FIG. 9 is a schematic diagram of circuitry constructed according to the invention.

FIGS. 9–14 of the drawings illustrate a sealant applying control system 150 for accomplishing the improved sealant application procedure. The system 150 functions to determine the location of spacer frames moving through the sealant applying station 44 and to control the application of sealant to the frame. Referring to FIG. 9, the system 150 comprises a frame locating network 152 for producing frame location signals, a signal processing network 154 for processing the location signals, nozzle control circuitry 156 for operating the extrusion nozzles in response to operation of the network 154 and a reset circuit 158. The reset circuit 158 conditions the control system 150 for applying sealant to a spacer frame when the machine 40 is initially started up as well as resetting the system 150 for operating on each of a succession of spacer frames fed to the station 44.

Figure 10:
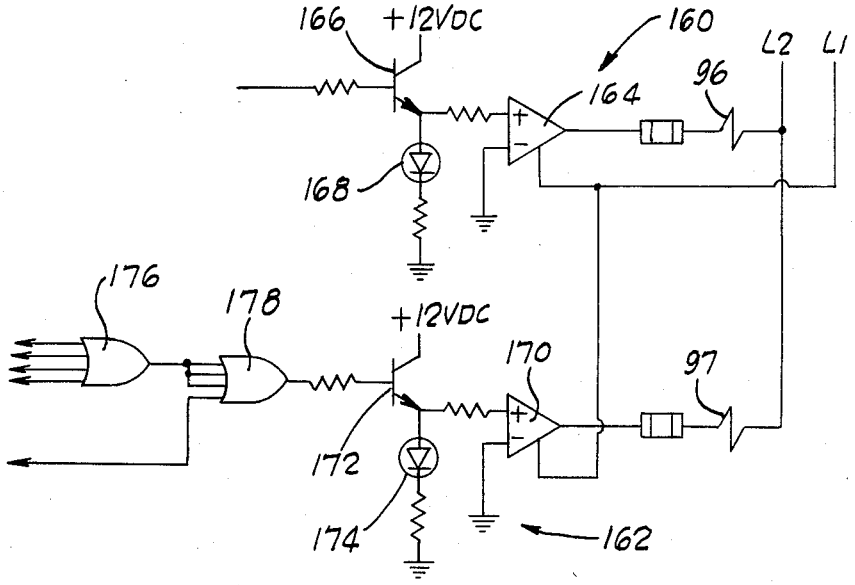
FIG. 10 is a schematic diagram of part of the circuitry of FIG. 9.

Referring now to FIG. 10 the control circuitry 156 is illustrated as controlling operation of the side nozzles and separately operating the bottom nozzle. In the preferred embodiment the control circuitry 156 includes a side nozzle controller 160 and a bottom nozzle controller 162. The side nozzle controller 160 includes the valve actuating solenoid 96 connected to a low voltage D.C. power supply across lines L1, L2 through a solid state relay 164. The conductive condition of the relay 164 is altered in response to signals produced from the network 154 to energize and deenergize the solenoid.

The solid state relay 164 is operated to energize and deenergize the solenoid 96 by an input transistor 166. The base electrode of the transistor 166 is connected to an output of the signal processing network 154. When the network 154 produces an output signal calling for operation of the side head controller 160 the transistor 166 is rendered conductive to provide an input to the solid state relay 164. The relay 164 is rendered conductive and energizes the solenoid 96. When the network 154 ceases to provide an output signal to the controller 160 the transistor 166 is rendered nonconductive and the solenoid 96 is deenergized.

A light emitting diode is connected in the collector-emitter circuit of the transistor 166 and is illuminated whenever the transistor is conductive to thus indicate operation of the side extrusion nozzles 50, 52.

The bottom extrusion nozzle controller circuitry 162 includes the solenoid 97 which is connected across the lines L1, L2 through a solid state relay 170. The relay 170 is operated to energize and deenergize the solenoid 97. The conductive condition of the solid state relay is controlled by a transistor 172 whose base electrode is connected to outputs from the signal processing network 154 via OR gates 176, 178. When any one of five individual output signals is provided from the network 154 to the OR gates 176, 178 the transistor 172 is rendered conductive to render the solid state relay 170 conductive. When a signal is no longer present at any of the inputs of the OR gates 176, 178 the transistor 172 is nonconductive and the solid state relay 170 deenergizes the solenoid.

A light emitting diode 174 is connected in the collector emitter circuit of the transistor 172 to provide a visual indication when the transistor 172 is conductive.

The interconnection of the network 154 and the bottom nozzle controller circuitry 162 is schematically illustrated in FIG. 9 for simplicity.

The location circuitry 152 is schematically illustrated in FIG. 9 and comprises a clock circuit 180, a spacer frame sensor 182 and a corner key sensor 184 which act in concert to provide input signals to the signal processing network 154.

The clock circuit 180 is an oscillator circuit constructed for continuously producing a constant frequency output pulse train which is input to the signal processing network 154. The clock circuit 180 may be of any conventional or suitable construction and is therefore only schematically illustrated. The frequency of the clock circuit is preferably in the vicinity of 2 kHz.

The frame sensor 182 produces an output signal which is supplied to the network 154 so long as the frame is present at a predetermined location with respect to the station 44. In the preferred embodiment the frame sensor 182 includes a photo eye detector 186 (see FIG. 4) which is set up along the path of travel of the frame segments adjacent the station 44 with a beam of light directed to the detector 186 across the travel path. The detector 186 is connected to a suitable or conventional signal processing circuit so that when the beam of light is broken by a frame moving to the station 44 an output signal is produced by the frame sensor 182 and fed to the signal processing circuitry 154. It should be noted that the detector 186 and its associated circuitry are constructed and arranged so that the frame sensor circuitry 182 continues to indicate the presence of the frame at the detection location as the successive corner keys pass the detector.

Figure 11:
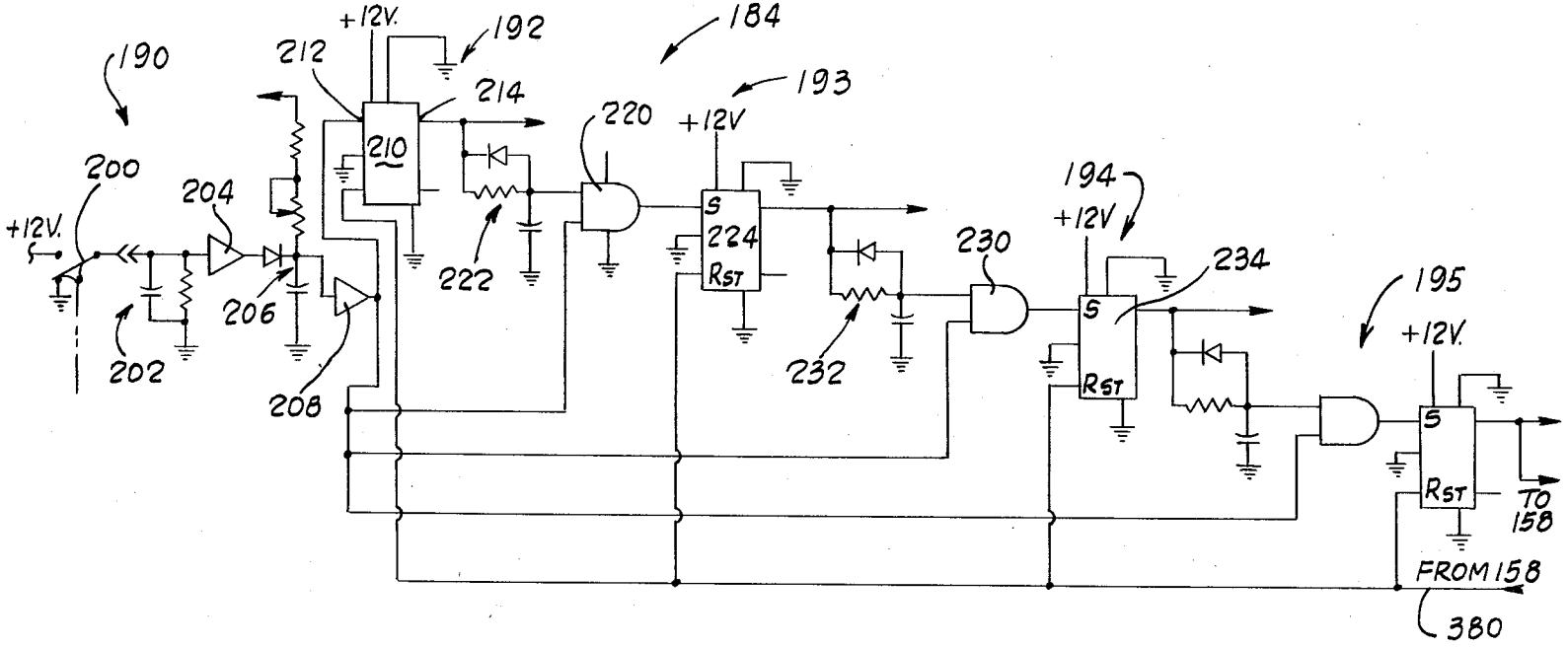
FIG. 11 is a schematic diagram of part of the circuitry of FIG. 9.

The corner key sensor 184 produces four separate output signals, one each in response to detection of the respective corner keys approaching the station 44. Referring to FIG. 11 the sensor 184 comprises an input signal circuitry 190 and four output signal producing circuits 192–195. The signal circuitry 190 produces a momentary signal when each of the frame corner keys is detected and the output signal producing circuits 192–195 produce individual continuous output signals corresponding to detection of the first, second, third and fourth corner keys, respectively.

The input circuitry 190 comprises a mechanical or photoelectric switch 200 located adjacent the sealant applying station 44 (see FIG. 4) and which is momentarily closed by engagement with each corner key approaching the station. In the preferred embodiment the switch 200 comprises a roller follower which rides along the frame segments and is shifted by the engagement with the individual corner keys to close the switch 200 briefly. Closure of the switch 200 completes an input circuit from a DC power supply through the closed contacts of the switch 200 to a filter 202 and the input of an amplifier 204. The output of the amplifier 204 is connected to the output signal producing circuits 192–195 through a filter 206 and a buffer 208.

When the corner key moves away from engagement with the roller follower the switch 200 reopens and the input signal is interrupted. Thus the detection of a corner key approaching the station 44 creates a brief DC pulse which is applied to the inputs of the circuits 192–195.

The circuits 192–195 are interconnected so that, although each is supplied with an input signal when any one of the corner keys is sensed approaching the station 44, the circuits 192–195 are rendered effective serially as the successive corner keys of each frame approach the station 44.

The signal circuit 192 produces an output signal when the first corner key of a frame is detected and also serves to enable the second signal circuit 193 to respond to detection of the next succeeding corner key. The circuit 192 comprises a flip-flop 210 having its set terminal 212 connected to the output buffer 208 and its output terminal 214 connected to the signal processing network 154 and to the second signal circuit 193. When the first corner key in the leading end of the first frame segment is detected by the switch 200 the signal circuit 192 is provided with a momentary signal to the set terminal 212 resulting in generation of a continuous output signal from the output terminal 214. The output signal is fed to the signal processing network 154 via a line 218. This output signal continues to be generated until the flip-flop 210 is reset.

The second corner key signal circuit 193 includes an input AND gate 220 having one of its input terminals connected to the output of the buffer 208 and its other input terminal connected to the flip-flop output terminal 214 via a time delay circuit 222. The output of the AND gate 220 is connected to the set terminal of a flip-flop 224 so that whenever both input terminals of the AND gate 220 are simultaneously supplied with input signals the AND gate produces an output signal which sets the flip-flop 224 to create an output signal at the flip-flop output terminal 226. The output signal at the terminal 226 indicates the presence of the second corner key adjacent the station 44 and is generated continuously until the flip-flop 224 is provided with a resetting signal to its reset terminal 228. The output signal is fed to the processing network 154 via a line 229.

The second corner key signal circuit 193 is prevented from producing an output signal when the first corner key is sensed by virtue of operation of the time delay circuit 222. The circuit 222 prevents an effective input signal from reaching the input terminal of the AND gate 220 until sufficiently long after the flip-flop 210 has produced its output signal that the switch 200 is no longer closed by the first corner key. In other words, the time delay circuit 222 prevents the AND gate 220 from being simultaneously provided with the output signal from the flip-flop 210 and the signal produced by the switch 200 sensing the first corner key.

Accordingly, the time constant of the time delay circuitry 222 is sufficiently long that the switch 200 is reopened by the first corner key prior to the signal being transmitted from the flip-flip output terminal 214 to the AND gate input terminal via the time delay circuit 222. On the other hand the time constant of the time delay circuit is sufficiently short that the AND gate input terminal is supplied with the output signal from the flip-flop terminal 214 shortly after the first corner key has been detected and well in advance of the closure of the switch contacts 200 by the second corner key.

The third corner key signal circuit 194 is constructed the same as the circuit 193 and includes an input AND gate 230, a time delay circuit 232 between the AND gate 230 and the flip-flop 224, and a flip-flop 234 which is set by the output of the AND gate 230 for producing a third corner key detection signal applied both to the network 154 (via a line 235) and to the fourth corner key circuit 195 for enabling that circuit to respond to sensing of the fourth corner key.

The fourth corner key signal circuit 195 is constructed like the circuit 194 and therefore is not described in further detail except to say that when the fourth corner key engages the roller follower of the switch 200 the fourth corner key detecting circuitry 195 produces an output signal which is indicative of the fourth corner key approaching the sealant applying station 44. This output signal is supplied to the network 154 and to the reset circuit 158 via a line 240. The corner key signal circuit 195 conditions the reset circuit 158 to reset the control system 150 each time a spacer frame is fed completely through the station 44.

The corner key signal circuits 192–195 continue to produce their respective output signals until the trailing end of the last frame segment has cleared the sealant applying station 44 at which time the system 150 is reset. When the system 150 is reset each of the corner key signaling flip-flops is reset to enable the circuitry 182 to detect the corner keys in a next succeeding frame approaching the sealant applying station.

The signal processing network 154 comprises extrusion nozzle controller circuits 250–254 for governing operation of the extrusion nozzles. The circuits 250–254 are each individually coupled to the clock circuitry 180, the frame sensor 182 and to the corner key sensor 184 so that the extrusion nozzle controller circuits operate independently in response to signals input to them. In addition, each controller circuit 250–254 operates to control the bottom nozzle 54 to provide a short strip of sealant material overlying a respective one of the corner keys and, in the case of the controller circuitry 254, at the trailing end of the last frame segment passing through the station 44.

In the preferred embodiment the controller circuit 254 additionally functions to initiate operation of the reset circuit 158 and to reset the controller circuits 250–253. In so doing the controller circuit 254 coacts with the circuit 250 to terminate operation of the side nozzles when sealant has been applied completely along the opposite sides of a frame passing through the station 44, including the corner keys.

Figure 12:
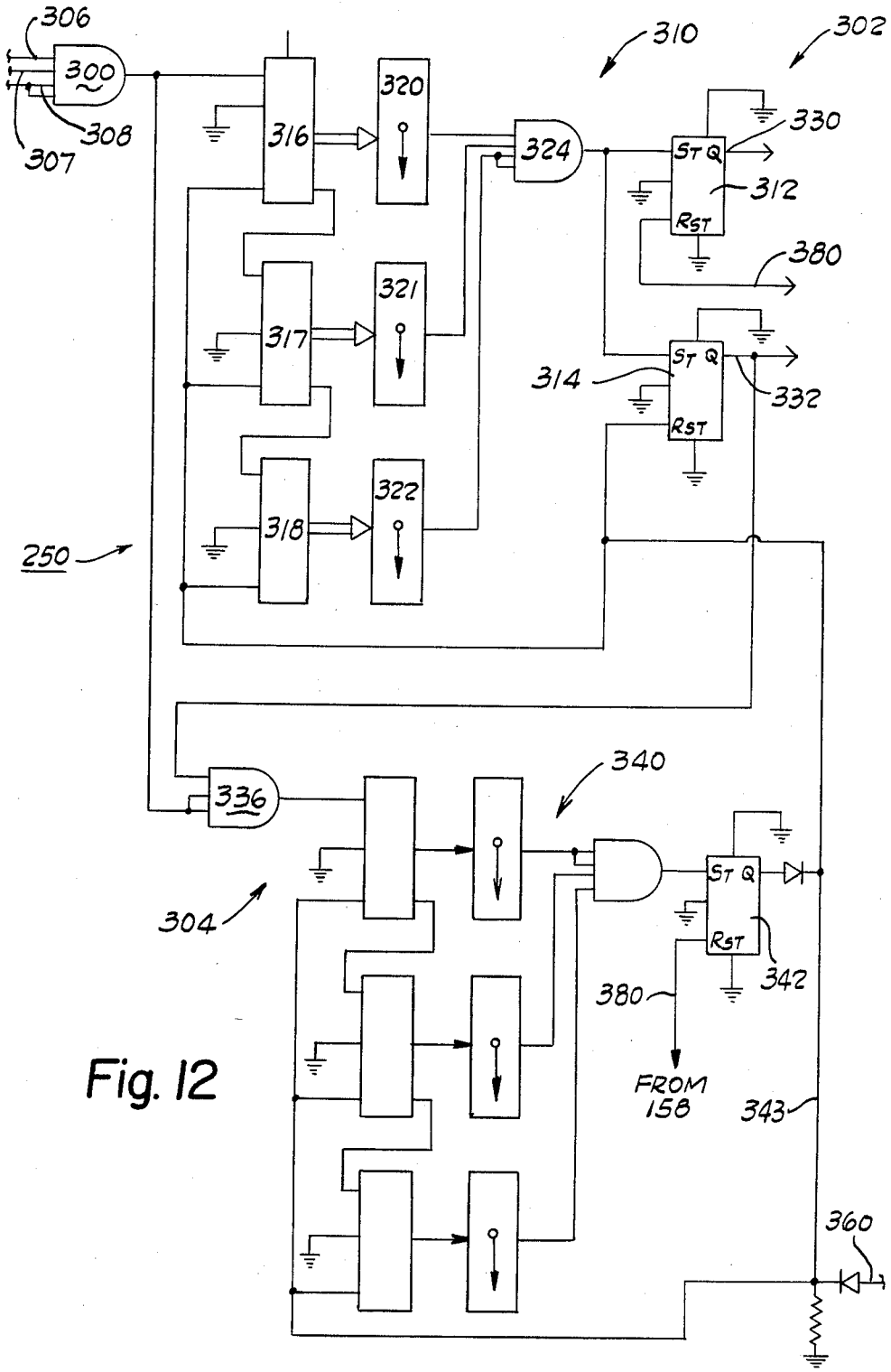
FIG. 12 is a schematic diagram of part of the circuitry of FIG. 9.

The controller circuit 250 is illustrated schematically by FIG. 12 and includes an input signal detector 300 for receiving signals from the circuits 180, 182, 184, an extrusion initiating circuit 302 for initiating operation of the side and bottom nozzle controllers 160, 162 and an extrusion termination circuit 304 for terminating operation of the bottom nozzle controller 162.

The input signal detector 300 is preferably an AND gate having input terminals 306–308 connected respectively to the circuits 180, 182, 184 so that when signals are input to the terminals 306–308 from all of these circuits the extrusion initiation circuit 302 and the extrusion termination circuit 304 are supplied with signals output from the AND gate 300. The feeding speed of the frame is set so that the frame moves at a known constant speed. Thus the first corner key reaches the sealant applying station 44 a predetermined time after the corner key detector and the frame sensor produce output signals. Since the output of the clock circuitry 180 is a pulse train the AND gate 300 provides a corresponding pulse train to the inputs of the extrusion initiation circuit 302 and to the extrusion termination circuit 304.

The extrusion initiation circuit 302 includes a pulse counting system 310, a side extrusion nozzle controlling flip-flop 312 and a bottom extrusion nozzle controlling flip-flop 314, both of which are set from the output of the pulse counting system 310. When set, these flip flops effect operation of the side and bottom extrusion nozzles.

In the preferred and illustrated embodiment the pulse counting system 310 comprises cascaded decimal counters 316–318 having their output terminals respectively connected to manually setable dip switches 320–322 whose outputs are in turn connected to a counter system output gate 324. The switches 320–322 are set so that as soon as the input terminals 307, 308 of the input AND gate 300 are supplied with signals the pulse counting system begins receiving a pulse train from the AND gate 300. After a predetermined number of pulses has been counted the output AND gate 324 is operated from the dip switches to provide a setting signal to the flip-flops 312, 314.

The output terminal 330 of the flip-flop 312 is connected to the base electrode of the transistor 166 (see FIG. 10) so that when the flip-flop 312 is set the side nozzle controlling solenoid 96 is energized and the side extrusion nozzle valve is opened to extrude sealant onto both sides of the corner key and spacer frame at the sealant applying station 44. The flip-flop 312 remains in its set condition until it is reset. The flip flop 312 is not reset until the spacer frame has completed its travel past the station 44. Energization of the solenoid 96 to extrude sealant onto the sides of the spacer frame assembly passing the station 44 is thus continuous so long as the spacer frame passes through the sealant applying station.

The output terminal 322 of the flip-flop 314 is connected to the base or control electrode of the transistor 172 (see FIG. 10) via the OR gates 176, 178 so that when the flip-flop 314 is set, the bottom extrusion nozzle actuating solenoid 97 is energized resulting in sealant being extruded onto the bottom of the corner key at the leading end of the spacer frame.

The flip-flop 314 remains set until it is reset by the extrusion termination circuit 304 at a time when a predetermined desired length of sealant has been applied to the bottoms of the corner key and adjacent portions of the spacer frame segments. In the preferred and illustrated embodiment the flip-flop output terminal 332 is coupled to the extrusion termination circuit 304 to enable that circuit to become effective.

The termination circuit 304 includes an input signal gate 336 coupled to the input AND gate 300 and to the flip-flop output terminal 332, a pulse counting system 340 connected to the output of the signal gate 336, and an extrusion terminating flip-flop 342.

The input signal gate 336 is preferably an AND gate having one input terminal connected to the output of the AND gate 300 and its other input terminal coupled to the flip-flop output terminal 332 so that the gate 336 is rendered effective to generate an output pulse train only when the flip-flop 314 is set and the gate 300 is producing an output pulse train. When the gate 336 is operated it produces a pulse train corresponding to the pulse train produced by the gate 300.

The pulse counting system 340 is constructed substantially the same as the pulse counting system 310 and is therefore not described further except to say that the dip switches are set so that the bottom extrusion nozzle directs sealant onto the corner key and spacer frame until a predetermined number of pulses is counted by the system 340 after which the pulse counting system 340 sets the terminating flip-flop 342 to terminate the operation of the bottom extrusion nozzle by resetting the flip-flop 314.

The flip-flop 342 is set by the output from the pulse counting system 340 and produces an output signal on a line 343 which resets the flip-flop 314 and also resets the pulse counting systems 310, 340. The flip-flop 342 remains set until it is reset at the end of the sealant applying cycle.

The extrusion nozzle controller circuits 251–254 are identical to the circuit 250 except that none of them includes a side nozzle controlling flip-flop corresponding to the flip-flop 312. Thus each of the circuits 251–253 functions to initiate and terminate operation of the bottom extrusion nozzle solenoid 97 to cause the application of a strip of sealant to the bottom of the frame segments overlying each entire respective corner key and extending a predetermined distance along the adjacent frame segments from that corner key.

The controller circuit 254 controls the bottom head extruder operation to place a short strip of sealant on the trailing frame segment and as it passes the station 44. When the frame is finally assembled the sealant at the leading and trailing frame segment ends is smoothed into place to completely bridge the corner formed by the leading and trailing frame segment ends. As noted previously the circuit 254 also functions to enable termination of the side extrusion nozzle operation via the reset circuit 158 and the controller circuit 250.

Figure 13:
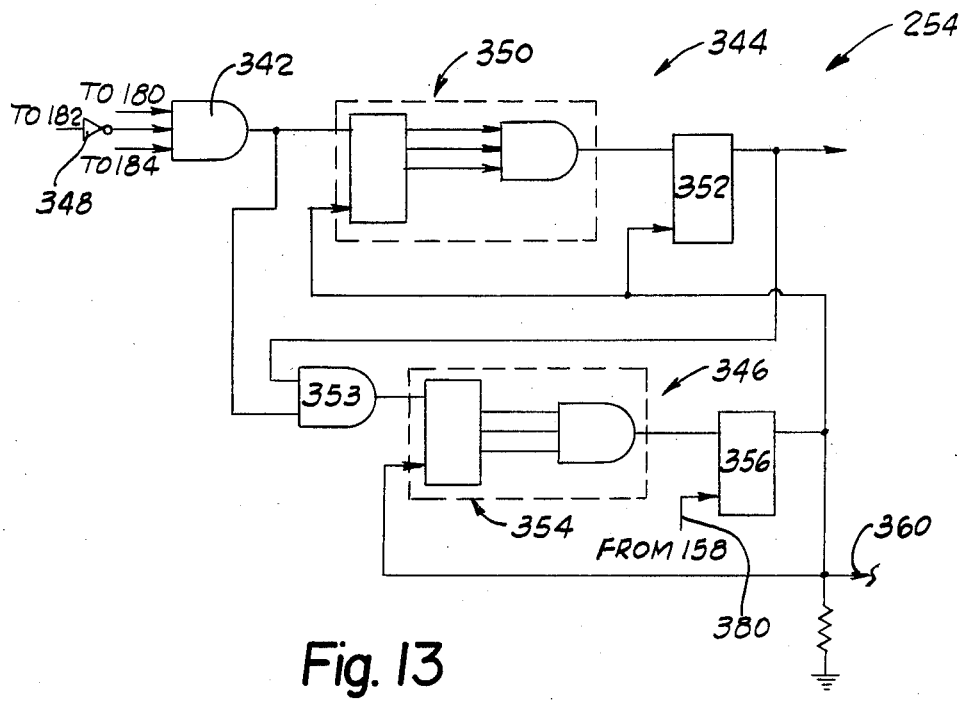
FIG. 13 is a schematic diagram of part of the circuitry of FIG. 9.

Referring now to FIG. 13 the controller circuit 254 is schematically illustrated and is constructed substantially identically to the controllers 251–253 referred to previously. The controller circuit 254 is provided with an input control gate 342, a bottom extrusion nozzle initiation circuit 344 and a bottom extrusion nozzle termination circuit 346. The input gate 342 functions like the input gate 300 described above except that an inverter 348 is connected between the output of the frame sensor 182 and the gate input. Accordingly when the fourth corner key is sensed, creating an input signal from the corner key sensor 184 to one input terminal of the gate 342 the gate 342 is not provided with an input signal from the frame segment sensor 182 until the frame segment is not sensed by the sensor 182. When the trailing frame segment is not sensed the inverter 348 produces an output signal and the input gate 342 is provided with signals from the circuits 180, 182, 184 for rendering the controller circuit 254 effective.

The bottom extrusion nozzle initiation circuitry 344 comprises a pulse counting system 350 coupled between the output of the gate 342 and the set terminal of a bottom nozzle controlling flip-flop 352. When a predetermined number of pulses is counted by the system 350 subsequent to the gate 342 being rendered effective, the flip-flop 352 is set to energize the bottom extrusion nozzle controlling solenoid 97 so that a strip of sealant is directed onto the frame segment near its trailing end.

The extrusion termination circuit 346 likewise includes an input gate 353, having its input terminals coupled between the gate 342 and the output of the flip-flop 352, a pulse counting system 354 coupled to the input gate 353 and an extrusion terminating flip-flop 356 operated from the pulse counting system 354.

The input gate 353 is rendered effective to provide a pulse train to the counting system 354 in response to setting of the flip-flop 352 and continued generation of a pulse train by the gate 342. The counting system 354 sets the flip-flop 356 after receipt of a predetermined number of pulses.

The flip-flop 356 resets the flip-flop 352 thus terminating operation of the bottom extrusion nozzle. The flip-flop 356 also resets the counter systems 350, 354 and provides a resetting output signal from the circuit 254 to the reset circuit 158 via a reset line 360. The reset circuit 158 responds by resetting the entire control system 150 for a succeeding cycle of operation of the machine 40. As an incident of its resetting function the reset circuit 158 terminates operation of the side extrusion nozzles 50, 52 by resetting the flip-flop 312 of the controller circuit 250.

Figure 14:
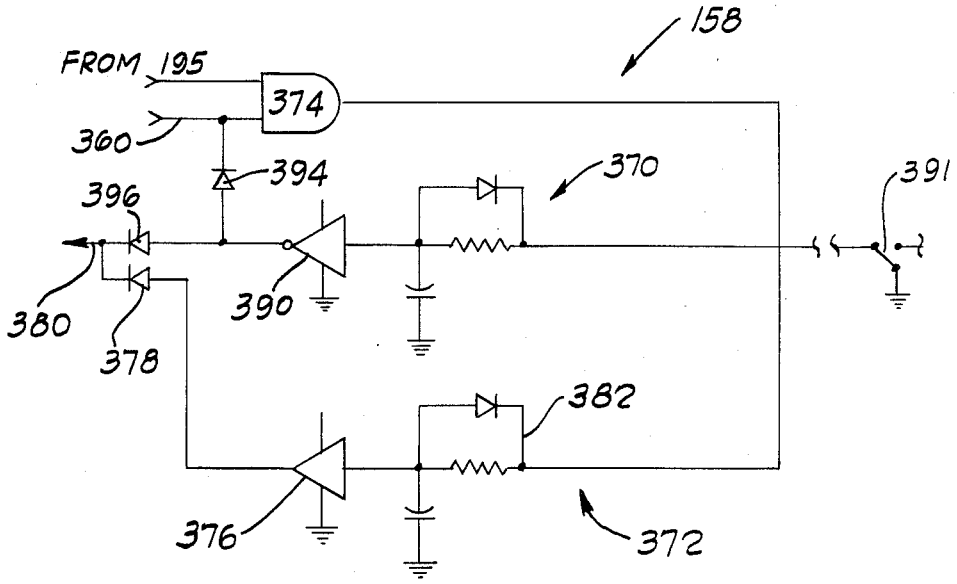
FIG. 14 is a schematic diagram of part of the circuitry of FIG. 9.

The reset circuit 158 is schematically illustrated by FIG. 14 of the drawings. The circuit 158 comprises an initial reset network 370 for conditioning the control system 150 to control application of sealant to a spacer frame when the machine 40 is initially turned on, and a cycle reset network 372 for resetting the control system 150 at the conclusion of each sealant application cycle.

The cycle reset network 372 comprises an input AND gate 374, a buffer 376 having its input coupled to the AND gate output and an output diode 378 poled to deliver the buffer output signal to a reset line 380. The reset line 380 is connected to the reset terminals of all the flip flops in the corner key sensor 184 (see FIG. 11), the reset terminals of the flip flops 312, 342 in the circuit 250, and the reset terminals of the flip flop 356 in the circuits 251–254 (see FIG. 13).

As illustrated by FIG. 14 the input AND gate has its input terminals connected to the fourth corner key signal circuit 195 and to the controller circuit 254, respectively. When the fourth corner key of a frame has been sensed and the controller circuit 254 terminated operation of the extrusion heads the AND gate 374 is provided with continuous input signals to both of its input terminals from the circuit 195 and the circuit 254, respectively. The AND gate produces an output which is fed to the buffer input via a filter 382. The resultant buffer output signal is delivered to the line 380 via the diode 378. The filter 382 prevents the buffer 376 from producing an output in response to spurious input signals.

The initial reset network 370 is rendered effective to reset the control system 150 when the machine 40 is initially turned on. The network 370 includes an inverter 390 having its input terminal connected to the machine on-off switch, or a switch associated with the on-off switch (indicated by the reference character 391 in FIGS. 9 and 14), via an R.C. timer 392. The inverter output terminal is connected to the lines 360, 380 via diodes 394, 396, respectively, so that when the inverter output produces a positive going signal the lines 360, 380 are supplied with resetting signals.

The switch 391 is closed upon initiating operation of the machine 40. The R.C. timer delays receipt of an input signal to the inverter 390 so that the inverter produces an initial resetting output signal when the switch is first closed. After a predetermined interval the R.C. timer delivers an input signal to the inverter which terminates the initial reset output signal. The input signal to the inverter is maintained so long as the machine 40 remains in operation. When the machine 40 is turned off the signal provided from the R.C. timer decays rapidly so that the initial reset network is enabled again.

It should be noted that the line 360 is connected to the controller circuits 250–253 via individual diodes 398 so that when the initial reset network 370 is operated the counters and bottom extrusion nozzle flip flops of each controller circuit are provided with reset signals. The controller 254 is, as noted previously, connected to the line 360 so that its counters and the flip flop 352 are also provided with initial reset signals. The diode 394 blocks any signal from the controller circuit 254 from the diode 396.

While a single preferred embodiment of the present invention has been illustrated and described in considerable detail, the invention is not to be considered limited to the precise construction disclosed. Various modifications, adaptations and uses of the invention may occur to those skilled in the art to which the invention relates. The intention is to cover hereby all such modifications, adaptations and uses which fall within the spirit or scope of the appended claims.

We claim:

1. A system for applying sealant to partially assembled spacer frames formed by a plurality of spacer frame segments having opposed free ends and adjacent ends connected at their junctures comprising:

(a) a sealant applying station defined by first and second sealant extrusion nozzles positioned for applying sealant to opposite sides of spacer frame segments and a third sealant extrusion nozzle positioned for applying sealant to a spacer frame side between said opposite sides;

(b) spacer frame advancing means for feeding a plurality of spacer frame segments along a path of travel to said station in substantial longitudinal alignment;

(c) extrusion nozzle control means for rendering said nozzles operative to apply sealant to said spacer frame segments passing through said sealant applying station in response to control signals;

(d) spacer frame detection means for producing signals indicating the presence of the spacer frame at said station; and, (e) signal processing means coupled to said detection means and to said nozzle control means for producing control signals for intermittently operating said third extrusion nozzle in response to the presence of the leading end of the spacer frame segments at said station, and the approach of the junctures of subsequent spacer frame segment ends and the trailing frame end, said third nozzle operated intermittently to apply sealant to said ends and the spacer frame junctures.

2. The system claimed in claim 1 wherein said spacer frame detection means comprises a frame segment detector disposed along said path of travel in the vicinity of said station for producing a frame segment detection signal and a signal generator for producing frame segment displacement signals, said detection and displacement signals input to said signal processing means.

3. The system claimed in claim 2 wherein said frame segment detector produces its detection signal so long as a part of a spacer frame segment is detected, said displacement signal generator produces a pulse train, said signal processing means including counting means for counting displacement signal pulses occuring after initiation of a detection signal and control signal producing circuitry coupled to said counting means for initiating operation of said third nozzle control means.

4. The system claimed in claim 3 wherein said signal processing means comprises circuitry responsive to termination of said frame segment for operating said nozzle control means to initiate and terminate operation of said third nozzle at the trailing end of said frame segments.

5. A method of constructing spacer frames comprising:

(a) connecting ends of spacer frame segments to form a longitudinally aligned succession of frame segments connected at adjacent ends;

(b) providing a sealant application station having a sealant extrusion nozzle for directing sealant onto one side of the spacer frame segments;

(c) feeding the spacer frame segments to the sealant applying station;

(d) detecting the leading end of the assembled spacer frame segments approaching the station and producing a detection signal and a timing signal;

(e) initiating and terminating operation of said nozzle in response to said signals to extrude sealant onto a short section of the frame side segment adjacent said leading end;

(f) detecting successive junctures of the frame segments approaching the station and producing juncture detection signals and timing signals;

(g) initiating and terminating operation of said nozzle in response to detection of successive frame segment junctures approaching said station to extrude sealant onto the frame segment sides adjacent the junctures with the sealant bridging the junctures;

(h) detecting the trailing end of the frame segments approaching the station and producing a detection signal and timing signal;

(i) initiating and terminating operation of the nozzle in response to the signals to apply a short section of sealant along the trailing end of the frame segment.

6. The method claimed in claim 5 wherein connecting ends of the frame segments includes attaching foldable connectors to the adjacent frame segment ends.

7. The method claimed in claim 6 wherein producing timing signals includes generating a fixed frequency pulse train continuously throughout the sealant applying operation.

8. The method claimed in claim 7 wherein producing detection signals comprises producing an individual detection signal for the leading spacer frame segment end and each successive spacer frame segment juncture.

9. The method claimed in claim 6 wherein detecting successive junctures comprises detecting successive foldable connectors between the frame segments.

10. A system for applying sealant to partially assembled spacer frames formed by a plurality of spacer frame segments extending in longitudinal alignment and connected together at junctures of adjacent ends comprising:

(a) a sealant applying station defined by first and second sealant extrusion nozzles positioned for applying sealant to opposite sides of spacer frame segments passing said station;

(b) advancing means for feeding the spacer frame segments along a path of travel extending through said station;

(c) extrusion nozzle control means for rendering said nozzles operative to apply sealant to said frame segments in response to control signals;

(d) spacer frame detection means for producing detection signals indicating the presence of a spacer frame at said station, said detection means comprising first signal producing means for generating a signal indicating the presence of a spacer frame approaching said station at a predetermined location on said path of travel and second signal producing means for generating a timing signal; and (e) signal processing means for producing nozzle operating control signals in response to operation of said detection means, said signal processing means comprising timing signal responsive means rendered effective in response to initiation of a signal from said first signal producing means for producing a nozzle operating control signal when the leading end of said spacer frame is at said station and rendered effective to terminate said nozzle operating control signal in response to said timing signal and to termination of a signal from said first signal producing means when the trailing end of the spacer frame is at said station.

11. The apparatus claimed in claim 10 wherein said second signal producing means comprises circuitry for generating a pulse train and said timing signal responsive means comprises circuitry for counting pulses.

12. The apparatus claimed in claim 11 wherein said pulse train is a constant frequency pulse train.

13. The apparatus claimed in claim 11 wherein said first signal producing means comprises a photosensitive element disposed along said path of travel and rendered effective by a spacer frame moving along said path of travel adjacent said element.

14. The apparatus claimed in claim 10 further including a third extrusion nozzle at said station for applying sealant to said frame segments on a third side thereof, said detection means comprising a third signal producing means for producing detection signals in response to the presence of the leading end of the spacer frame approaching said station and to the presence of successive frame junctures approaching said station, said signal processing means comprising timing signal responsive means rendered effective in response to signals from said third signal producing means and to said timing signal for producing third nozzle controlling signals so that said third nozzle applies sealant to said spacer frame intermittently at the frame segment junctures.

15. The apparatus claimed in claim 14 further comprising reset means responsive to the trailing end of the spacer frame passing the station for conditioning said detection means for the approach of a succeeding spacer frame.

16. A system for applying sealant to partially assembled spacer frames formed by a plurality of spacer frame segments extending in longitudinal alignment and connected together at junctures of adjacent ends comprising:

(a) a sealant applying station defined by a sealant extrusion nozzle positioned for applying sealant to one side of spacer frame segments passing said station;

(b) advancing means for feeding the spacer frame segments along a path of travel extending through said station;

(c) extrusion nozzle control means for rendering said nozzle operative to apply sealant to said frame segments in response to control signals;

(d) spacer frame detection means for producing detection signals indicating the presence of a spacer frame at said station, said detection means comprising first signal producing means for generating signals indicating the presence of spacer frame segments approaching said station on said path of travel, second signal producing means for generating timing signals and third signal producing means for generating frame segment juncture signals indicating frame segment junctures approaching said station; and (e) signal processing means for producing nozzle operating control signals in response to operation of said detection means, said signal processing means comprising first signal responsive means rendered effective in response to initiation of a signal from said first signal producing means and said timing signals for producing a nozzle operating control signal to initiate and terminate operation of said nozzle when the leading end of said spacer frame is at said station, second signal responsive means responsive to said frame segment juncture signals and said timing signals for initiating and terminating operation of said nozzle to apply sealant to said frame segments adjacent and bridging said junctures.

17. The system claimed in claim 16 further including third signal responsive means responsive to said timing signals and to the termination of signals from said first signal producing means for initiating and terminating operation of said nozzle to apply sealant to the trailing end of the frame segments passing said station.

18. A method of constructing spacer frames for insulating glass panels comprising:

(a) connecting ends of spacer frame segments to form a longitudinally aligned succession of frame segments connected at adjacent ends;

(b) providing a sealant application station having a sealant directing nozzle for directing sealant onto one side of the spacer frame segments;

(c) feeding the spacer frame segments to the sealant applying station;

(d) detecting the leading end of the assembled spacer frame segments approaching the station and producing a timing signal;

(e) initiating and terminating operation of said nozzle in response to said timing signal to direct sealant onto a short section of the frame segment side adjacent said leading end;

(f) producing successive timing signals as respective successive junctures of the frame segments and the trailing end of the frame segments approach the sealant applying station; and, (g) initiating and terminating operation of said nozzle in response to said timing signals to direct sealant onto the frame segment sides adjacent the junctures with the sealant bridging the junctures, and to apply a short section of sealant along the trailing end of the frame segment.

19. The method claimed in claim 18 further including flexing said frame segments at the junctures and connecting the leading and trailing frame segment ends together to form a polygonal spacer frame with sealant material applied along the exterior corners thereof.

20. The method claimed in claim 18 further including detecting the approach of successive spacer frame segment junctures to said sealant applying station and producing timing signals responsive thereto.

21. The method claimed in claim 18 wherein producing timing signals includes generating a fixed frequency pulse train continuously throughout the sealant applying operation.

22. The method claimed in claim 18 further including applying sealant material substantially continuously along at least a second side of the connected frame segments, the sealant material on said second side being substantially contiguous the sealant material on said first mentioned side.

* * * * *